US005127530A

United States Patent [19]

Ortuno

[11] Patent Number: 5,127,530

[45] Date of Patent: Jul. 7, 1992

[54] GOLF CLUB STAND

[76] Inventor: Jorge Ortuno, 1661 West Ave., Miami Beach, Fla. 33139

[21] Appl. No.: 601,138

[22] Filed: Mar. 22, 1991

[51] Int. Cl.[5] ..... A47F 7/00

[52] U.S. Cl. ..... 211/70.2; 206/315.2; 273/32 E

[58] Field of Search ..... 211/70.2; 273/32 E, 273/32 H; 206/315.2; 248/530

[56] References Cited

U.S. PATENT DOCUMENTS

| | | | |
|---|---|---|---|
| 2,716,432 | 8/1955 | Duffy | 206/315.2 |
| 2,858,868 | 11/1958 | Wallace | 273/32 E |
| 2,887,137 | 5/1959 | Robb | 273/32 E X |
| 3,858,833 | 1/1975 | Fink | 248/530 X |
| 4,509,751 | 4/1985 | Tabet | 273/32 H |
| 4,938,446 | 7/1990 | Williams | 248/530 |

*Primary Examiner*—Robert W. Gibson, Jr.
*Attorney, Agent, or Firm*—Lawrence E. Laubscher, Jr.

[57] ABSTRACT

A golf club stand is characterized by a unitary frame having leg and receptacle portions. The lower end of the leg is inserted into the ground and the receptacle portion is spaced above the ground to support the grips of a plurality of golf clubs. The stand is lightweight and used by a golfer to support a number of golf clubs when the golfer is separated from his golf bag. The stand minimizes the chances that the golfer's clubs will be lost or left behind after a shot and also prevents the clubs from being soiled since they are supported up upright by the stand rather than laid on the ground. A flag attached to the stand serves as a wind indicator.

3 Claims, 1 Drawing Sheet

GOLF CLUB STAND

BACKGROUND OF THE INVENTION

During a round of golf, a golfer might use five or more golf clubs which are stored in a golf bag. Often, the bag is placed on a golf cart which in most instances must be kept either on a cart path or in the rough of a golf hole. Unfortunately, a golfer does not always hit his golf shots in an area where the cart an be driven. Furthermore, because most carts are shared with another golfer, it is a rare occurrence that both golfers hit their shots adjacent to each other.

Accordingly, golfers frequently leave their bags and take a few (i.e. two or three) clubs with them and walk to their balls. Only after looking at the forthcoming shot does the golfer actually select the club to be used to play the shot. The remaining clubs are typically laid on the ground while the shot is made and then retrieved and returned to the golf bag.

A number of problems arise with this procedure. First, the grips of the clubs laid on the ground become wet or soiled. With the passage of time, the grips and the club shafts deteriorate owing to the chemicals used on many golf courses. Secondly, clubs are often lost or forgotten in deep grasses or around the green. This all too common occurrence is particularly annoying to golfers having a matched set of clubs. Many times a pitching or sand wedge is left on the apron of a green after a golfer has completed putting out the hole. Finally golf is a very popular aport among the elderly and the handicapped. For many of these avid golfers, it is difficult to bend over and retrieve golf clubs which have been laid on the ground.

The present invention was developed in order to portable, lightweight golf club stand which fits within the golfer's bag but can be removed and carried with a limited number of clubs to the location of a golf ball to support the non-selected clubs while the golfer strokes the ball.

SUMMARY OF THE INVENTION

Accordingly, it is a primary object of the present invention to provide a golf club stand including a unitary portable frame formed from a rigid cylindrical rod which is bent to define leg and receptacle portions. The lower end of the leg portion is adapted to be inserted into the ground. At the upper end of the leg portion the receptacle portion is spaced from the ground to support the grips of a plurality of golf clubs with the club heads resting on the ground. The receptacle portion is U-shaped and includes spaced arms and a lower bridge connected between the arms. The bridge supports the clubs and the arms prevent them from falling down.

According to a further object of the invention, the frame includes a reversely folded portion and a reversely folded lip at the upper ends of the spaced receptacle arms. When the stand leg portion is placed in a golf bag, the reversely folded portion and lip slip over the upper edge of the bag to hold the stand on the bag. A wind indicating flag is secured to the reversely folded lip.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
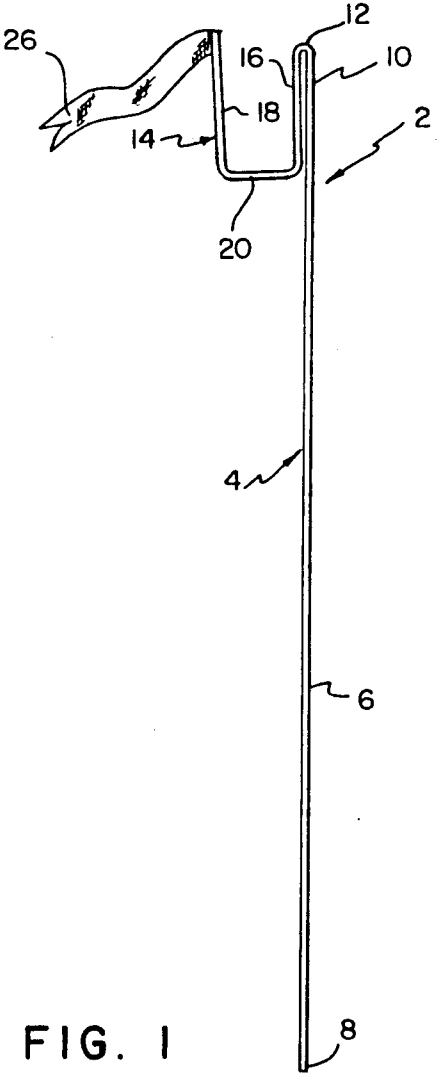
FIG. 1 is a front plan view of the golf club stand according to the invention.

Referring now to the drawing, there is shown in FIG. 1 the golf club stand 2 according to a preferred embodiment of the invention. The stand includes a unitary, rigid frame formed of a cylindrical rod 4. The rod is formed of a lightweight material such as steel or synthetic plastic material which is bent or molded into the unique configuration shown in the drawing.

Figure 2:
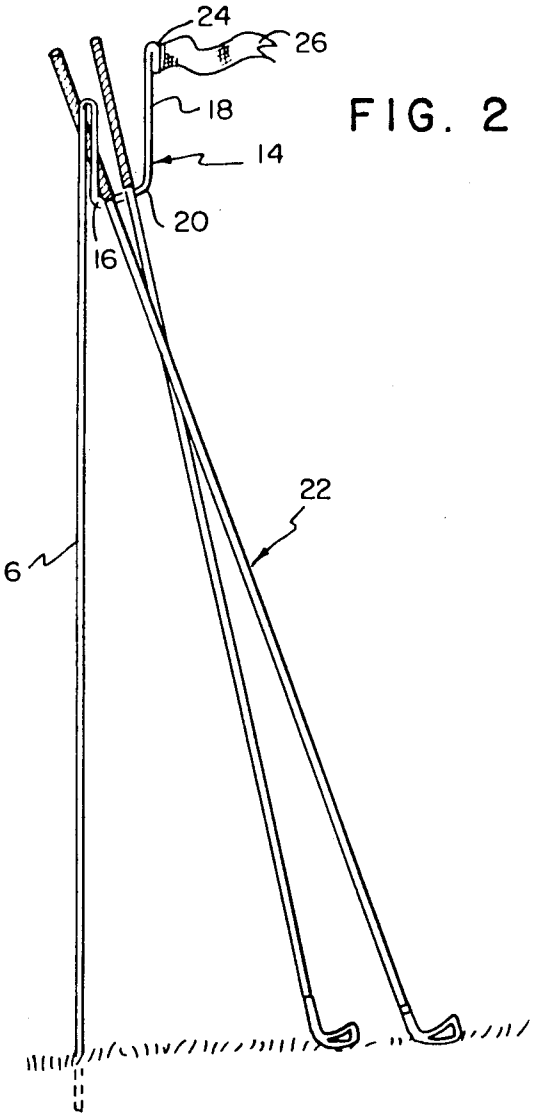
FIG. 2 is a plan view of the stand of FIG. 1 in its operable position implanted in the ground and supporting a plurality of golf clubs.

The frame includes a leg portion 6 having a lower end 8 which is adapted to be inserted into the ground as shown in FIG. 2. The leg portion has an upper end 10 spaced from the ground and from which extends a reversely folded portion 12.

The frame also includes a receptacle portion 14 comprising a first arm 16 depending from the reversely folded portion 12 in spaced parallel relation with the leg portion 6, a second arm 18 spaced from and parallel to the first arm 16, and a bridging portion 20 arranged between the lower ends of the first and second arms. Thus, the receptacle portion has a generally U-shaped configuration for receiving the grip portions of a plurality of golf clubs 22 when the stand is in the operable position shown in FIG. 2.

Figure 3:
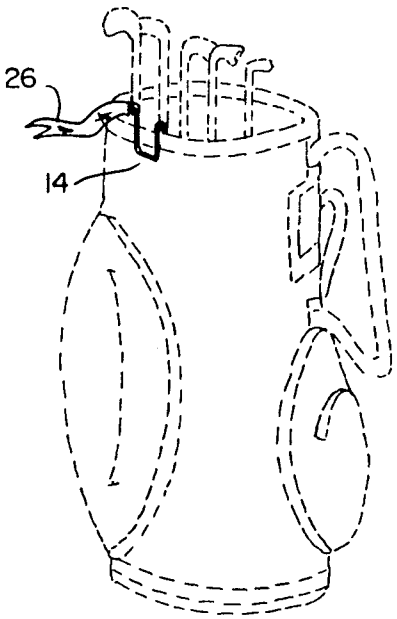
FIG. 3 is an illustration of the stand of FIG. 1 in its inoperable position mounted in a golf bag.

As shown in FIGS. 2 and 3, the upper end of the second arm 18 includes a reversely folded lip 24 extending downwardly therefrom in spaced relation from the second arm. The reversely folded portion 12 and lip 24 enable the stand to be secured in a golf bag when the stand is in the inoperable position shown in FIG. 3. More particularly, the leg portion 6 of the stand is inserted into the golf bag with the upper edge of the bag supporting the reversely folded portion 12 10 and lip 24.

A flag or banner 26 is connected with the lip 24 and serves as an indicator of the wind direction.

In use, the golfer removes the stand from the bag together with a preliminary selection of golf clubs which the golfer anticipates might be used to play a particular shot. The golfer then walks to his ball, inserts the stand in the ground, and rests the clubs on the stand with the club heads on the ground and the grips arranged in the receptacle portion as shown in FIG. 2. The golfer selects a club and plays his shot while the non-selected clubs rest on the stand. After the shot, the stand is pulled from the ground and carried with the clubs back to the golf bag which normally remains on a golf cart.

While in accordance with the provisions of the patent statute the preferred forms and embodiments have been illustrated and described, it will be apparent to those of ordinary skill in the art that various changes and modifications may be made without deviating from the inventive concepts set forth above.

I claim:

1. A golf club stand for supporting the grip portion of at least one golf club whose head portion is resting on the ground, comprising a unitary portable frame formed from a rigid cylindrical rod, said frame including (a) a leg portion having a lower free end adapted to be inserted into the ground and an upper end spaced from the ground;

(b) a reversely folded portion extending from said leg portion upper end; and (c) a receptacle portion extending from reversely folded portion, said receptacle portion including (1) a first arm spaced from and parallel to said upper end of said leg portion;

(2) a second arm spaced from and parallel to said first arm; and (3) a bridging member extending between lower ends of said first and second arms, whereby when said leg portion is inserted in the ground, the grip portion of at least one golf club can be supported by said receptacle portion and when said leg portion is placed in a golf bag, said reversely folded portion supports said frame with said receptacle portion arranged outside of the bag, the bag being sandwiched between said leg portion upper end and said receptacle first arm.

2. A golf club stand as defined in claim 1, wherein said frame receptacle portion includes a reversely folded lip extending from an upper end of said second arm for engaging an upper end edge of the golf bag when said frame leg portion is inserted in the bag.

3. A golf club stand as defined in claim 2, and further comprising a flag connected with said lip for indicating wind direction.

* * * * *